United States Patent [19]

Pfleger

[11] 4,226,376

[45] Oct. 7, 1980

[54] AMPULE BREAKER

[76] Inventor: Frederick W. Pfleger, 1152 Barbara Dr., Cherry Hill, N.J. 08003

[21] Appl. No.: 950,812

[22] Filed: Oct. 12, 1978

[51] Int. Cl.[3] ..... B02C 19/00

[52] U.S. Cl. ..... 241/99; 225/93; 225/103; 241/168

[58] Field of Search ..... 241/99, 168–169.2, 241/DIG. 27; 225/93, 103

[56] References Cited

U.S. PATENT DOCUMENTS

| | | | |
|---|---|---|---|
| 2,359,644 | 10/1944 | Hoey | 241/99 UX |
| 2,503,517 | 4/1950 | Sirica | 241/99 UX |
| 2,638,022 | 5/1953 | Reyes | 241/99 UX |
| 3,380,636 | 4/1968 | Ushkow et al. | 225/103 |
| 3,450,319 | 6/1969 | Ray et al. | 241/99 X |
| 3,552,083 | 1/1971 | Andersen et al. | 241/99 UX |

*Primary Examiner*—Howard N. Goldberg
*Attorney, Agent, or Firm*—Robert K. Youtie

[57] ABSTRACT

A device for breaking various size ampules at the ampule neck, which is the most convenient break point for extracting the fluid from the ampule. The ampule breaker comprises a formed structure having a wedge surface which contacts the ampule at the neck and sides adjacent to the wedge which are contoured to contact the extremities of the appendage to be broken off from the ampule. The contoured sides extend beyond the point where the extremities contact so that no matter which size ampule is inserted into the breaker, a mechanical advantage is provided to help break the ampule appendage. A staggered set of cover plates are used to retain the ampule appendage during and after breaking.

2 Claims, 3 Drawing Figures

AMPULE BREAKER

BACKGROUND OF THE INVENTION

The present invention relates to an improved method for breaking an ampule appendage from the fluid container portion of an ampule. When ampules were first used in industry it was necessary to score the glass at the neck of the ampule with a file or similar instrument and then by hand break the ampule on the scored lines. An improvement in ampules provided an etched break line in the neck of the ampule at the time of manufacture. This eliminated the need for the file, but breaking of the ampule still had its problems due to variations in the etch, variations of the length of the appendage to be broken off, and the strength of the person breaking the ampule. As a result pliers and other tools were used to help in the breaking. This procedure was improved on by special tools being designed to help in breaking of an ampule.

Although several types of these special ampule breakers are marketed today and in some cases are patented as U.S. Pat. No. 3,450,319, all of the existing breakers have shortcomings. These shortcomings include: the ampule breaker is capable of operating with only one given size ampule, the ampule breaker does not provide mechanical advantage therefore not aiding in the breaking operation, or the ampule breaker does not provide sufficient protection to avoid accidental cuts or brasions from the broken glass. It therefore is extremely desirable to have a single ampule breaker that can be used on a series of a group of sizes of ampules as well as protecting the operator from physical injury while still providing a mechanical advantage to reduce the force required in the breaking operation.

Therefore it is a primary object of this invention to provide an ampule breaker that is capable of breaking a plurality of sizes of ampules.

It is another object of this invention to provide an ampule breaker that adds a mechanical advantage for the operator.

It is another object of this invention to provide an ampule breaker which provides protection to the operator in use.

It is another object of this invention to provide an ampule breaker in which the broken appendage is retained in the breaker for easy disposal.

It is another object of this invention to provide a low cost ampule breaker.

These and other objects of this invention will become more apparent from the following descriptions and drawings.

BRIEF SUMMARY OF THE INVENTION

The ampule breaker covered by this invention consists of a cavity into which the ampule appendage is inserted with the balance of the design providing the safety and leverage required to make a good ampule breaker. The ampule is inserted into the ampule breaker in such a manner that a fulcrum edge of the breaker locates against the neck of the ampule. An extending surface from the fulcrum is contoured in such a manner that the extremities of the ampule appendage of the various size ampules contact the contoured surface. These two points of contact on the ampule form the portion of the lever acting on the ampule. The ampule breaker body extends beyond the appendage contact point a distance so that the extension forms the mechanical advantage portion of the lever. This extension can be a single bar or can be another ampule breaker back-to-back such that one side of the breaker can be used for a given series of sizes of ampules and the other side can be used for a different series of sizes of ampules. Either type of extended portion thus can be considered the equivalent of a handle, the added length required to form the lever arm. The extending contoured surfaces extending from the fulcrum point are as wide as the largest diameter ampule appendage for the particular group. Extending across these surfaces are covers which cover the appendage portion of the ampule to be broken when it is inserted into the ampule breaker both before and after breaking the ampule. Captivating the appendage provides the safety required for a good ampule breaker.

DESCRIPTION OF PREFERRED EMBODIMENT

Figure 1:
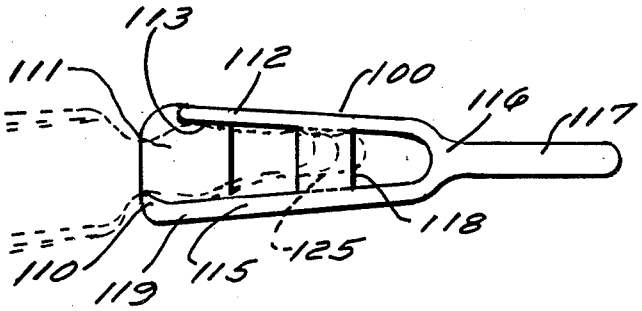
FIG. 1 is a plan view of the ampule breaker showing several ampule sizes adaptable into the breaker and with a handle lever arm.

Referring to the drawings and more particularly to FIG. 1, the ampule breaker 100 comprises a rigid fulcrum surface 110 projecting upwardly from a bottom retaining plate 111. Also attached to bottom retaining plate 111 and projecting upwardly therefore is a contoured surface structure 112. This contoured surface structure 112 extends away from the fulcrum surface 110, a distance related to the length of the ampule appendage to be inserted into the breaker within its design range. The extremity of the appendage of the ampule will contact the contoured force exerting surface 113 of the contoured surface structure 112 at its extremity.

As shown in FIG. 1, three different size ampules are shown in dotted lines indicating how the contoured force exerting surface 113 contacts the extremity of the appendge of the various ampules while the fulcrum 110 always remains in contact with the breaking neck of the ampule. The fulcrum surface 110 is secured to the bottom retaining plate 111 by means of the fulcrum structure 115 which extends in the same direction away from the fulcrum as the contoured surface structure 112. The fulcrum structure 115 and the contoured surface structure 112 join at a vertex 116 from which extends a handle extension 117. In order to secure greater rigidity between the fulcrum structure 115 and the contoured surface structure 112, the contoured surface structure 112 and the fulcrum structure 115 are tied together by means of a top retaining plate 118. Top retaining plate 118 and bottom retaining plate 111 form a cavity which locates and retains the appendage 125 of the various size ampules as shown in FIG. 1. This cavity retains the ampule appendage both prior to breaking the appendage from the ampule and after the ampule appendage has been broken from the ampule.

As shown in FIG. 1, if the ampule body is held in one hand and the extension 117 of the ampule breaker 100 is held in the other hand, a leverage is obtained for breaking the appendage which leverage is formed by the fulcrum surface 110, the contoured force exerting surface 113, and the handle 117. To further aid in the breaking operation, the thumb of the hand holding the handle 117 can be placed against the outer surface 119 of the fulcrum structure 115 to aid in the rotational movement about the fulcrum surface 110.

Figure 2:
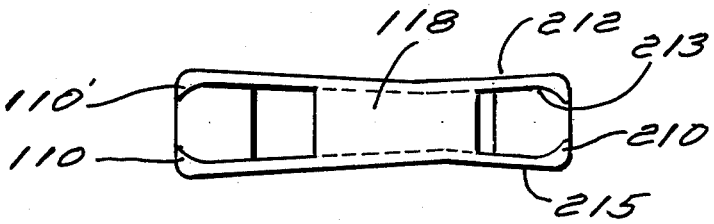
FIG. 2 is a plan view of the ampule breaker showing a back-to-back configuration in which one side is used for one series of sizes and the other side is used for a second series of sizes.

Since it is a major object of this invention to use a single ampule breaker for as many size ampules as possible, the structure of the ampule breaker shown in FIG. 2 can be substituted for the extension 117 shown in FIG. 1. As shown in FIG. 2 a second fulcrum surface 210 and a second contoured surface structure 212 is provided. The contoured surface structure 212 has a second contoured surface 213. A second fulcrum structure 215 is also provided. As a result the extension 117 is reconfigured such that it forms a second cavity for smaller ampules as shown in FIG. 2. Obviously this second cavity could be formed to take larger ampules rather than smaller ampules.

Figure 3:
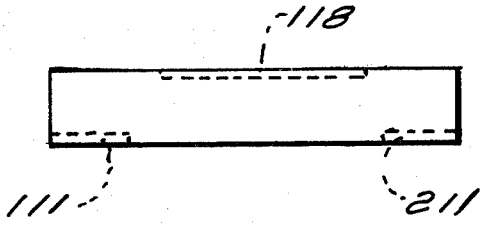
FIG. 3 is an elevation drawing of the ampule breaker showing the means by which the ampule appendage to be broken is captive in the ampule breaker.

In order to make the ampule breaker as universal as possible, it is desirable to enable the ampule breaker to break the ampule by either clockwise or counterclockwise rotation of the users hand. As a result as shown in FIG. 2, two fulcrums 110–110', two contoured force exerting surfaces 213, two contoured surface structures 212 and two fulcrum structures 215 are provided. These enable the ampule to be fulcrumed at either side of the appendage 125 and therefore enable the ampules to be broken by either clockwise or counterclockwise movement. The fulcrums 110–110' and 210 are made of rigid material and are attached to the lower retaining plates 111 and 211, FIG. 3. As was previously described, in order to provide further rigidity to the contoured surface structure 112 and the fulcrum structure 115, an upper retaining plate 118 is secured to the upper portion of these members. The bottom retaining plates 111 and 211 and the retaining plate 118, therefore, can be used to form the appendage cavities and to retain the appendage 125 after it is broken from the ampule regardless of whether the larger sizes are broken or the smaller sizes are broken. The broken appendge 125 can be removed from the cavity simply by turning the ampule breaker over. As a result it can be seen that what has been described, is an ampule breaker which will break many size ampules, is an ampule breaker which is provided with a mechanical advantage or a leverage to assist in the breaking function, is an ampule breaker having a cavity retaining structure to help prevent accidental injury to the user.

These advantages and others are not to be limited to the drawings or description above, but by the appended claims in which I claim:

1. An ampule breaker comprising a one piece structure having two sides and two ends, each of said ends having two fulcrum surfaces extending inwardly from each of said sides, the fulcrum surfaces at one end being closer together than the fulcrum surfaces at the other end for breaking engagement with different size ampules at the different ends, said sides having internal contoured surfaces converging toward each other away from said fulcrum surfaces with the internal contoured surfaces adjacent to said one end being closer together than the internal contoured surfaces adjacent to said other end for bearing engagement with different size ampules adjacent to different ends, and retaining means for retaining a fixed relationship between each of said fulcrum surfaces and the internal contoured surfaces.

2. An ampule breaker according to claim 1, wherein said fulcrum surfaces and said sides at each end are positioned in such a position with respect to the size of an ampule to act as a lever for breaking an ampule with the opposite end.

* * * * *